US005862748A

United States Patent [19]

Witter

[11] Patent Number: 5,862,748

[45] Date of Patent: Jan. 26, 1999

[54] MANUAL REFUSE COMPACTOR

[76] Inventor: Lowell F. Witter, 450 S. Belmont, Elgin, Ill. 60123

[21] Appl. No.: 744,375

[22] Filed: Nov. 7, 1996

[51] Int. Cl.[6] ..... B30B 15/06

[52] U.S. Cl. ..... 100/265; D7/682; D8/14; D15/123; 100/295

[58] Field of Search ..... 100/35, 226, 265, 100/295, 299; 68/122, 215–219; 4/255.01, 255.11, 255.12; D7/682; D8/14; D15/123; D32/35; 404/133.1; 241/169.2, 168

[56] References Cited

U.S. PATENT DOCUMENTS

| | | | |
|---|---|---|---|
| D. 46,997 | 2/1915 | Howell | 4/255.11 |
| 193,480 | 7/1877 | Cady et al. | 68/122 |
| 205,500 | 7/1878 | Patterson | 68/215 |
| D. 206,926 | 2/1967 | Lurski . | |
| 215,588 | 5/1879 | Dolman | 68/122 |
| D. 256,770 | 9/1980 | Broyles . | |
| 330,296 | 11/1885 | Critchfield | 68/215 |
| 378,711 | 2/1888 | Nelson | 68/215 |
| 498,118 | 5/1893 | Hopkins . | |
| 597,333 | 1/1898 | Snow | 68/215 |
| 741,409 | 10/1903 | Oines . | |
| 1,005,950 | 10/1911 | Forkner | 68/218 |
| 1,069,750 | 8/1913 | Williams et al. | 4/255.11 |
| 1,852,071 | 4/1932 | Becker . | |
| 1,874,048 | 8/1932 | Kelley . | |
| 1,960,902 | 5/1934 | Freyn . | |
| 2,203,185 | 6/1940 | Walus | 4/255.11 |
| 2,579,671 | 12/1951 | Holl | 4/255.11 |
| 3,438,322 | 4/1969 | Marasco . | |
| 3,565,351 | 2/1971 | Ross, Jr. | 100/295 |
| 3,760,718 | 9/1973 | Adornetto . | |
| 3,779,157 | 12/1973 | Ross, Jr. et al. . | |
| 3,850,094 | 11/1974 | Shontz . | |
| 4,158,995 | 6/1979 | Kaplan et al. . | |
| 4,395,792 | 8/1983 | Cosner . | |
| 4,622,702 | 11/1986 | Allen | 4/255.11 |
| 4,629,233 | 12/1986 | Pfisterer . | |
| 4,682,539 | 7/1987 | Bramblett et al. . | |
| 4,991,500 | 2/1991 | Knapp . | |
| 5,062,329 | 11/1991 | Connolly et al. . | |
| 5,090,309 | 2/1992 | Lai . | |
| 5,090,756 | 2/1992 | Pfisterer . | |

FOREIGN PATENT DOCUMENTS

| | | | |
|---|---|---|---|
| 91452 | 2/1923 | Austria | 4/255.11 |
| 11564 | of 1887 | United Kingdom | 68/215 |

*Primary Examiner*—Stephen F. Gerrity
*Attorney, Agent, or Firm*—Craig A. Summerfield; Brinks Hofer Gilson & Lione

[57] ABSTRACT

A compactor comprises a body having a connector side and a compacting side. A lip extends from the compacting side. The lip forms and at least partially surrounds a cavity on the compacting side. Finally, a connector is provided on the connector side. A handle connects to the connector, and the cavity has a v-shape surface structure. The user grasps the handle and repeatedly lowers the compactor to compact the debris.

21 Claims, 4 Drawing Sheets

MANUAL REFUSE COMPACTOR

FIELD OF THE INVENTION

The present invention relates generally to compactors. More particularly, the invention relates to a hand-held compactor for compacting leafs or other refuse.

BACKGROUND OF THE INVENTION

Household and yard waste is typically placed in various types of containers. Metal and plastic containers are often used for various waste. Further, plastic and paper bags are also used. Local waste services typically charge, in part, by the number of containers that must be emptied or removed.

As more communities offer or require yard waste recycling, the potential for added disposal costs increases. Compacting the waste may reduce the number of containers and cost of removal, particularly for yard waste. For example, leaves may be easily compacted.

Others have created devices for compacting leaves. For example, U.S. Pat. Nos. 4,629,233 and 5,090,756 to Dieter E. Pfisterer disclose devices for compacting material such as leaves, grass and trash. These devices include a specialized flat faced rake and funnel combination. Leaves or other refuse is pushed with the rake into the funnel. The funnel directs the refuse into a container for disposal. However, these devices require storage of the funnel, and the specialized rakes may not adequately break-up and compact the waste.

Devices for compacting household or restaurant waste, instead of leaves, have also been developed. For example, U.S. Pat. No. 4,158,995 to Kaplan et al. discloses a device for compacting waste. A handle is attached to a metal compacting head. The compacting head has a flat, open framework. However, waste may get caught in or on top of the open framework, and the metal construction may result in added manufacturing costs.

Therefore, there is a need for an apparatus that is compact for storage and acts to break-up and compact waste, whether yard or household waste, without getting waste lodged in the compactor.

SUMMARY OF THE INVENTION

The present invention provides a manual refuse compactor for breaking up and compacting waste. The compactor comprises a body having a connector side and a compacting side. A lip extends from the compacting side. The lip forms and at least partially surrounds an cavity on the compacting side. Finally, a connector is provided on the connector side.

In one embodiment, a handle connects to the connector, and the cavity has a v-shape surface structure.

A method of using the compactor is provided. The user grasps the handle and repeatedly lowers the compactor to compact the debris.

It is to be understood that both the foregoing general description and the following detailed description are exemplary and are intended to provide further explanation of the invention as claimed. The invention, together with further objects and attendant advantages, are best understood by reference to the following detailed description in conjunction with the attached drawings.

DETAILED DESCRIPTION OF THE PRESENTLY PREFERRED EMBODIMENTS

Figure 1:
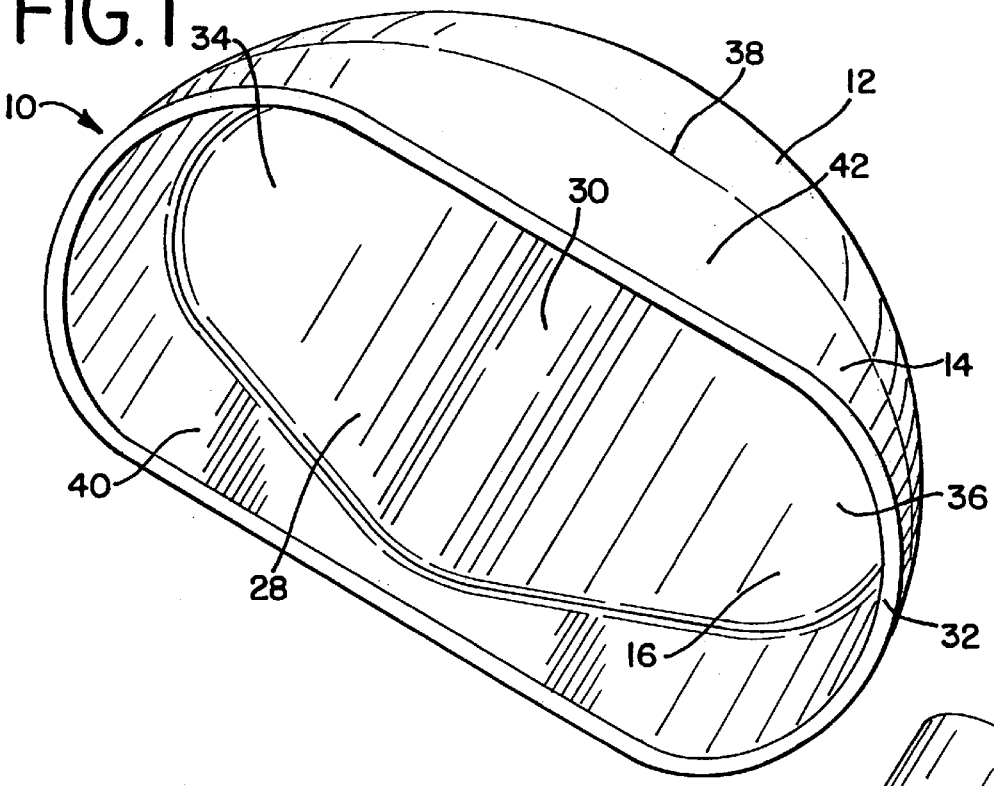
FIG. 1 is a perspective view of a manual refuse compactor.
Figure 3:
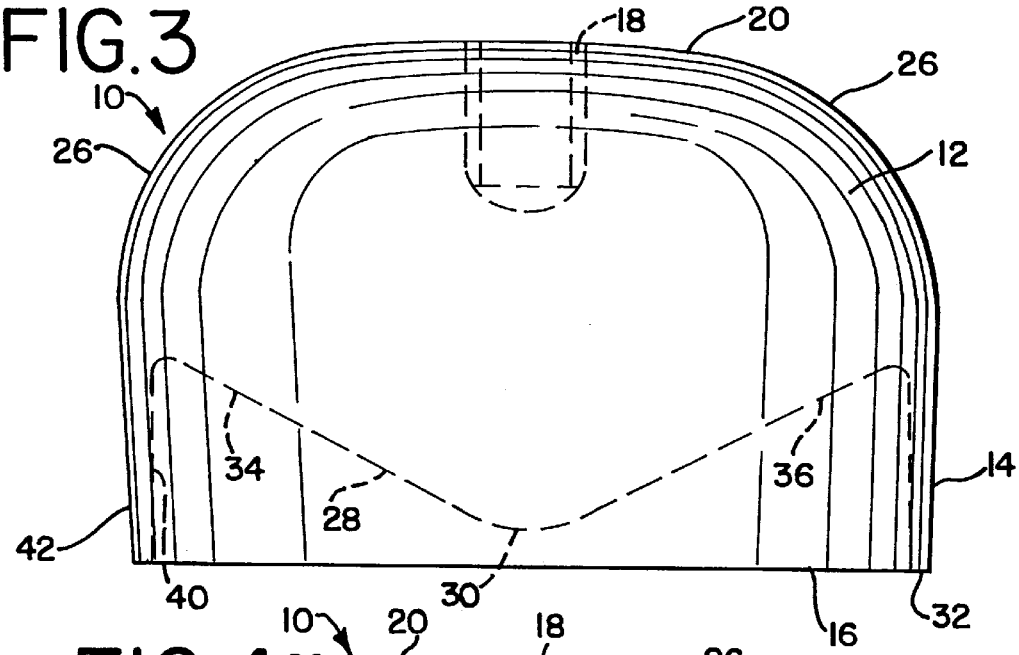
FIG. 3 is a cross sectional front side view of the manual refuse compactor of FIG. 1.
Figure 4:
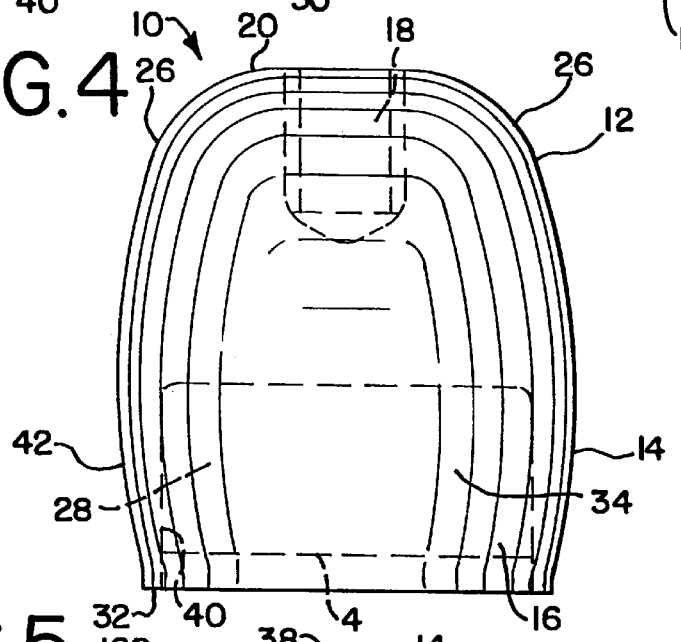
FIG. 4 is a side view of the manual refuse compactor of FIG. 1.

Referring now to the drawings and more particularly to FIGS. 1, 3 and 4, the manual refuse compactor is generally shown at 10. The compactor 10 includes a body 12, a lip 14 and a cavity 16. Preferably, the lip 14 extends from the body 12 to create the cavity 16. Compactor 10 is preferably about seven (7) inches long, four (4) inches wide and five (5) inches tall. However, compactor 10 may be of various sizes.

The lip 14 and body 12 may comprise a singular piece of material. Preferably, the lip 14 and body 12 are made from blow molded plastic. Alternatively, suitable metals, such as aluminum, may be milled, lathed and tapped to form lip 14 and body 12. Preferably, the body 12 is rigid. The body 12 is solid. The solid structure of body 12 adds weight to the compactor 10 for better compacting. Alternatively, weights or voids could be added to the body 12 to create a desired weight for compactor 10.

Figure 6:
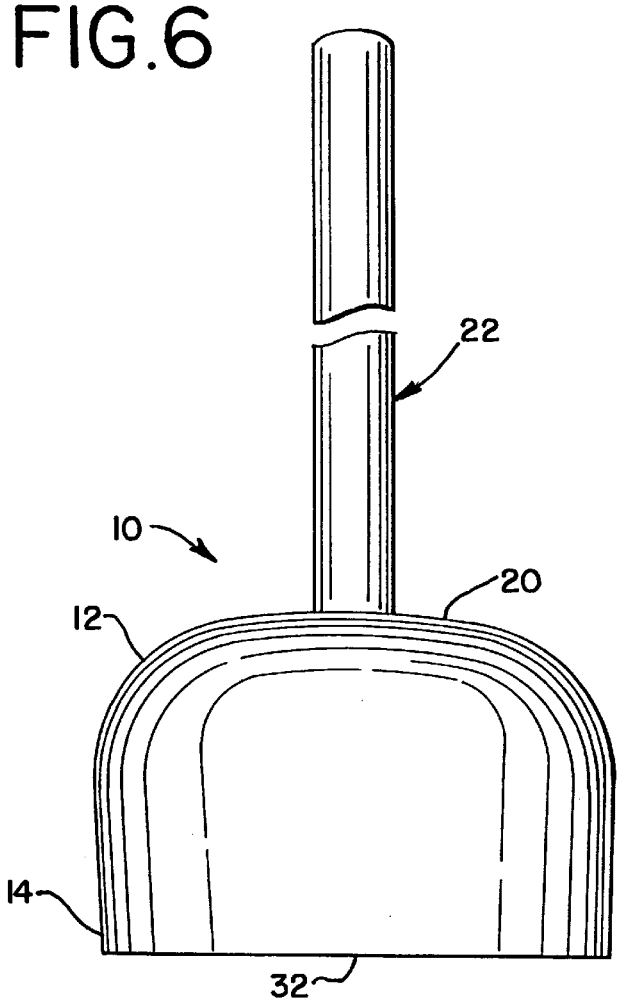
FIG. 6 is a front side view of the manual refuse compactor of FIG. 1 with a handle attached.
Figure 7:
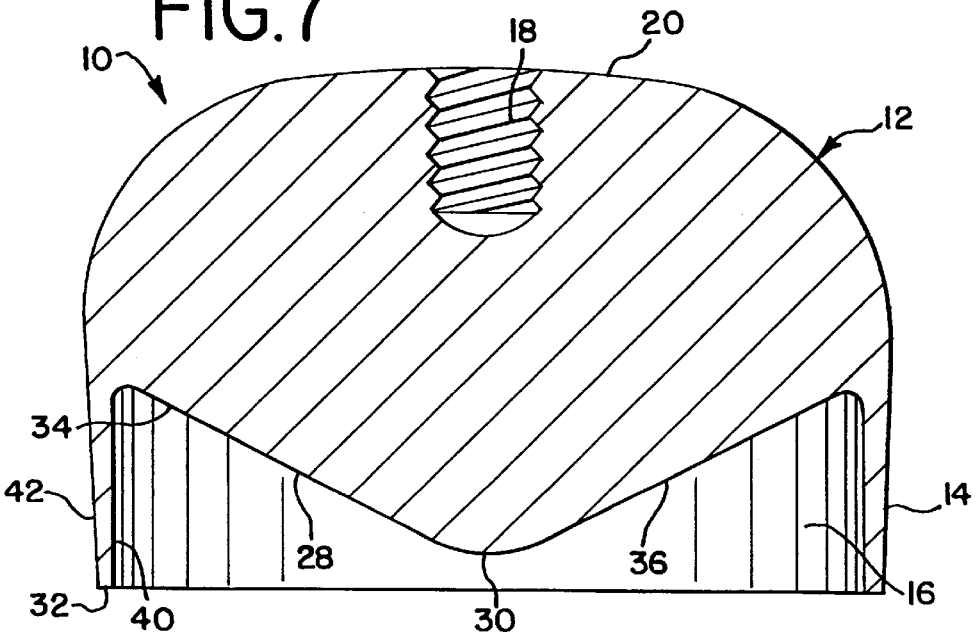
FIG. 7 is a cross sectional front side view of the manual refuse compactor of FIG. 1 with threading for attaching a broom handle.

Referring now to FIGS. 3, 4, 6 and 7, the body 12 has a connector 18. Preferably, the connector 18 is on the top 20 of the body 12. The connector 18 allows the attachment of a handle 22, such as a broom stick. Preferably, the connector 18 is a threaded hole for receiving a broom stick as shown in FIG. 7. Other connectors could be used, such as a bolt or cotter pin connection. Further, the connector 18 could comprise a handle molded as part of the body 12.

Figure 8:
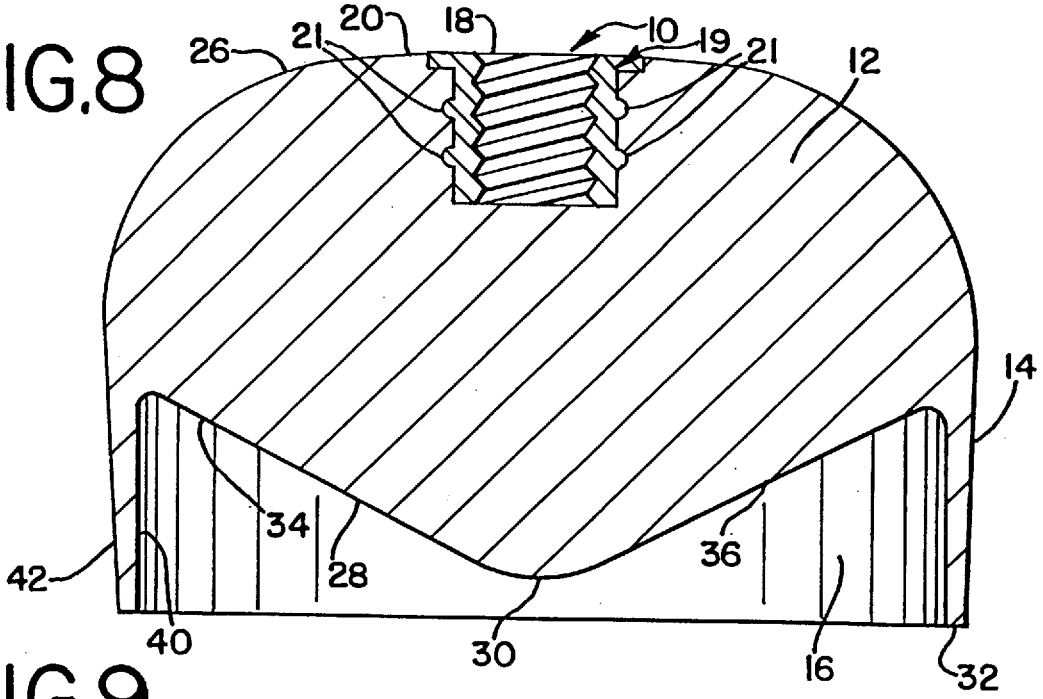
FIG. 8 is a cross sectional front side view of the manual refuse compactor of FIG. 1 with an insert.
Figure 9:
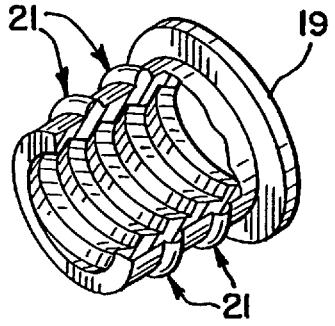
FIG. 9 is a perspective insert for use with the manual refuse compactor of FIG.1 with a cut-out exposing the threaded interior.

Referring to FIGS. 8 and 9, alternatively, the connector 18 comprises an insert 19. The insert 19 is made from metal, but other materials may be used. The insert 19 has a threaded interior. Ribs 21 are placed on the outside of insert 19. The insert 19 is placed in a hole in the body 12. The ribs 21 hold the insert in place in the body 12. A broom handle is attached to the threaded interior of the insert 19. Further, the broom handle may have a threaded metal cap for connection with insert 19.

Figure 2:
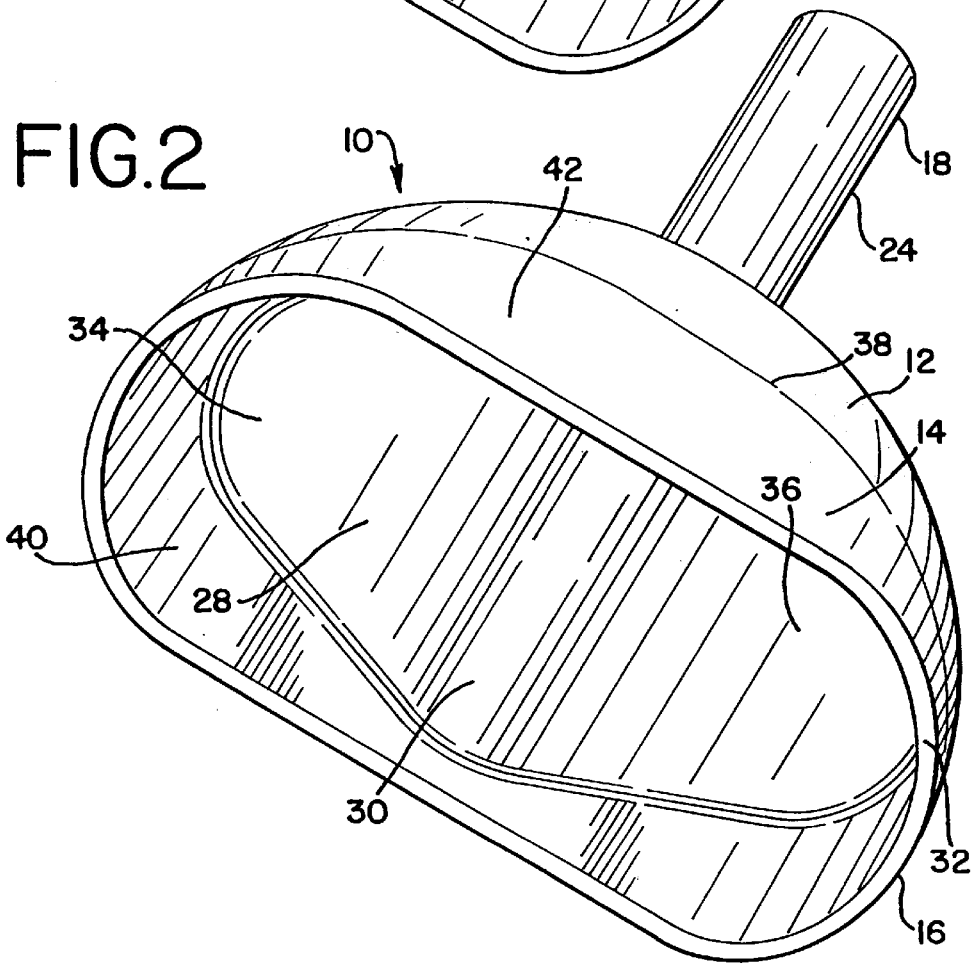
FIG. 2 is a perspective view of a manual refuse compactor with an extension for a handle.

Referring to FIG. 2, another alternative body 12 and connector 18 is provided. A connection extension 24 is provided. The connector 18 is on the connection extension 24. The connection extension 24 may be connected to body 12 by any means and is preferably molded as one piece with body 12.

Referring back to FIGS. 3 and 4, the body 12 preferably has sloped or radiused transition from the top 20 to the sides. Sloped edges or radius 26 on the top 20 provide the transition. The radius 26 is outward from the connector 18. The radius 26 allows waste to fall from the compactor 10 and avoids collecting the waste on the top 20 of body 12.

Referring to FIGS. 1 and 3, the cavity 16 is shown. The cavity 16 is created by the extension of lip 14 from the body 12. Lip 14 surrounds cavity 16. Alternatively, lip 14 may have gaps or an open end, so that lip 14 only partially surrounds the cavity 16. Also, lip 14 may comprise several separate lips at least partially surrounding respective cavities. The bottom 28 of body 12 further defines the cavity 16.

The bottom 28 generally comprises a first half 34 and a second half 36. Bottom 28 may be of any surface texture. Preferably, the first and second halves 34, 36 have a smooth surface texture and are flat. First and second halves 34, 36 join at the crown 30. Thus, the bottom 28 has a v-shaped surface as shown in FIGS. 3 and 7. The v-shaped surface does not have any holes into which waste may get trapped.

Alternatively, bottom 28 may have other surface shapes. Thus, crown 30 may be formed by other extending structures. For example, several conical protrusions or multiple v-shaped protrusions could be formed on bottom 28.

Preferably, the crown 30 extends from bottom 28 away from body 12 and towards lip edge 32. The crown 30 does not extend to lip edge 32.

The v-shaped surface prevents waste from getting trapped within the cavity 16. The crown 30 acts to bend or break waste and helps prevents suction in the cavity 16 as the compactor 10 is lifted away from the compacted refuse. Any waste trapped in cavity 16 is easily removed by hand. The bottom 28 pushes the debris downward to pack the debris firmly. Alternatively or additionally, holes through body 12 could be provided to reduce suction, but such holes may trap debris.

Figure 5:
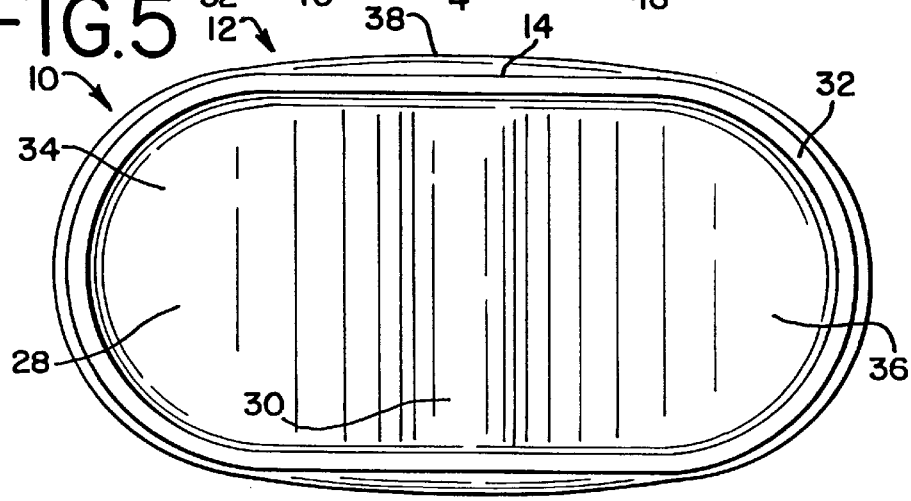
FIG. 5 is a bottom view of the manual refuse compactor of FIG. 1.

Referring to FIG. 5, the circumference 38 of bottom 28 and body 12 have an oval shape or a rectangular shape with rounded corners. Other shapes may be used. Preferably, the circumference 38 is rounded. Any corners may act to damage or rip the waste container as the compactor 10 is used.

Lip 14 extends from the bottom 28 generally at the circumference 38. The lip 14 may extend from the bottom 28 at different points, such as further inward from circumference 38. Thus, lip 14 is rounded to avoid damaging or ripping the waste container. Referring to FIGS. 3 and 4, lip 14 and body 12 join and form a continuous slightly curved surface. The curved surface has a smooth texture to avoid catching on debris. The curve of the surface avoids damaging or ripping the waste container.

The lip 14 has an inner side 40, an outer side 42 and the lip edge 32. As noted above, the outer side 42 joins body 12 to form the curved surface. Preferably, there is not a jagged edge or protrusion at the junction. The inner side 40 is generally parallel to the outer side 42. The inner side 40 also has a smooth surface texture. The inner side 40 is preferably flat and smooth so that debris does not get caught on the inner side 40. Other surface textures could be used.

Lip edge 32 joins the inner side 40 and the outer side 42. Preferably, lip edge 32 is one tenth (1/10) to one half (1/2) inch wide. The thickness adds structural support to the lip 14 for compacting or breaking waste such as sticks or other less malleable debris. The lip edge 32 breaks or bends debris to better compact the debris. Preferably, lip edge 32 is rounded at the junction with outer side 42. Such rounding avoids damage to the waste container as the compactor 10 is used. Lip edge 32 may also be rounded at the junction with inner side 40, but is preferably angular to better break or even cut debris.

Alternatively, inner side 40 and outer side 42 may join at a point, without lip edge 32. The point junction would act to cut the debris, but may be more prone to damage from the debris. If compactor 10 is made from metal or other more durable material, a cutting edge may be preferable but may cause damage to the waste container.

To use the compactor 10, handle 22, as shown in FIG. 6, is attached to the body 12. Alternatively, handle 22 may be molded or otherwise already attached to body 12. Preferably, handle 22 is a broom handle with threading and is threaded into body 12.

The waste to be compacted, such as household waste or yard waste, is placed in the container. For example, leaves may be placed in a paper yard waste bag. The user grabs handle 22 and inserts the compactor 10 into the container or just above the container. The compactor 10 is pushed downward to compact the debris in the container. Preferably, the compactor 10 is raised and then pushed down multiple times. Each time the compactor 10 is lowered, a different location in the container should be compacted. These steps are repeated and result in compacted debris.

The weight of compactor 10, in conjunction with the pushing, acts to compact the debris. Thus, the waste is compacted firmly. More waste may then be placed into the container for compacting.

A wide range of changes and modifications can be made to the preferred embodiment described above. For example, various handles 22 or connectors 18 could be used instead of a broom handle and threading. Thus, it is the following claims, including all equivalents, which are intended to define the scope of this invention.

I claim:

1. An apparatus for manually compacting refuse, said apparatus comprising:

a) a body having a connector side and a compacting side, the compacting side having a circumference shape comprising two parallel lines connected by two curved surfaces;

b) a lip extending from the compacting side, the lip forming and at least partially surrounding a cavity on the compacting side;

c) said cavity comprising a crown; and d) a connector on the connector side.

2. The apparatus of claim 1 wherein the body is solid.

3. The apparatus of claim 1 wherein the body is plastic.

4. The apparatus of claim 1 wherein:

the connector side is a top of the body; and the top of the body is slopped away from the connector.

5. The apparatus of claim 1 wherein:

the lip has an outer side and an inner side; and the inner and outer sides are smooth.

6. The apparatus of claim 5 wherein the outer side is parallel with the inner side.

7. The apparatus of claim 1 wherein the compacting side has a rounded circumference.

8. The apparatus of claim 7 wherein the lip at least partially extends from the rounded circumference.

9. The apparatus of claim 8 wherein the lip has a lip edge, the lip edge comprising the same shape as the rounded circumference.

10. The apparatus of claim 1 wherein the lip has a lip edge, the lip edge being substantially flat.

11. The apparatus of claim 1 wherein the connector joins a handle to the body as a one-piece construction.

12. The apparatus of claim 1 wherein said crown comprises a first and a second surface connected in a v-shape.

13. The apparatus of claim 12 wherein:

the first surface is a first half of the cavity; and the second surface is a second half of the cavity.

14. The apparatus of claim 12 wherein:

the first surface is flat; and the second surface is flat.

15. The apparatus of claim 12 wherein the lip comprises a lip edge, wherein a first distance between the connector and the lip edge is larger than a second distance between the connector and a connection edge of the first and second surfaces.

16. The apparatus of claim 1 wherein the connector comprises a threaded hole.

17. The apparatus of claim 16 wherein:

the connector side has a connection extension; and said threaded hole is in the connection extension.

18. The apparatus of claim 16 wherein a handle connects to the threaded hole.

19. The apparatus of claim 1 wherein a handle is connected to the body by the connector.

20. The apparatus of claim 1 wherein the lip extends from the compacting side substantially parallel to a center axis through the connector.

21. An apparatus for manually compacting refuse, said apparatus comprising:

a) a body having a connector side and a compacting side;

b) a lip extending from the compacting side, the lip forming and at least partially surrounding a cavity on the compacting side;

c) said cavity comprising a crown, the crown comprising first and second uninterrupted surfaces connected in a v-shape along a substantially linear edge; and d) a connector on the connector side.

* * * * *

UNITED STATES PATENT AND TRADEMARK OFFICE

CERTIFICATE OF CORRECTION

PATENT NO. : 5,862,748

DATED : January 26, 1999

INVENTOR(S) : Lowell F. Witter

It is certified that error appears in the above-identified patent and that said Letters Patent is hereby corrected as shown below:

On the Title Page

In column 2, line 1, under "ABSTRACT", after "compactor" please insert --is provided and--.

Signed and Sealed this

Tenth Day of April, 2001

Nicholas P. Godici

*Attest:*

NICHOLAS P. GODICI

*Attesting Officer*

*Acting Director of the United States Patent and Trademark Office*